United States Patent [19]

Alletto

[11] Patent Number: 4,630,521

[45] Date of Patent: Dec. 23, 1986

[54] DRUM HEAD RETAINER

[76] Inventor: Darro F. Alletto, 13434 Chandler Blvd., Van Nuys, Calif. 91401

[21] Appl. No.: 819,750

[22] Filed: Jan. 16, 1986

Related U.S. Application Data

[63] Continuation-in-part of Ser. No. 668,392, Nov. 5, 1984, abandoned.

[51] Int. Cl.[4] ..... G10D 13/02

[52] U.S. Cl. ..... 84/413; 84/411 R

[58] Field of Search ..... 84/411–420

[56] References Cited

U.S. PATENT DOCUMENTS

| | | | |
|---|---|---|---|
| 1,391,786 | 9/1921 | Nelson | 84/411 R |
| 2,092,980 | 9/1937 | Ludwig | 84/411 R |
| 3,865,003 | 2/1975 | Della-Porta | 84/411 R |
| 4,122,747 | 10/1978 | Yamashita | 84/411 R |
| 4,154,136 | 5/1979 | McIntyre | 84/411 A |
| 4,282,793 | 8/1981 | Muchnick | 84/414 |

*Primary Examiner*—Lawrence R. Franklin

*Attorney, Agent, or Firm*—Cislo, O'Reilly & Thomas

[57] ABSTRACT

A drum head retainer (20) is provided which indicates the extent of tension applied to a drum head of a drum (10). The retainer comprises a casing (22) having a vertical channel (23) and an apertured side (24) which communicates with the vertical channel. The vertical channel terminates in an upper opening (26) and a lower opening (28). Screws (30) are used to attach the retainer to the side wall (12) of the drum. A threaded bolt (32) passes downwardly into the vertical channel through the upper opening thereof. The bolt is threaded into a flanged nut (34) having a predetermined length. The upper end of the bolt is adapted to pass through means (18), such as a hoop or rim, for providing tension to the drum head. A spring (42) is maintained in the casing between the upper opening and the flange (38) of the nut. Indicating means (21) are provided on the apertured side and display a measure of tension applied to the drum head by means of the position of the top end (40) of the nut with respect thereto.

14 Claims, 8 Drawing Figures

DRUM HEAD RETAINER

CROSS-REFERENCE TO RELATED APPLICATION

The present application is a continuation-in-part application of Ser. No. 668,392, filed Nov. 5, 1984 now abandoned.

BACKGROUND OF THE INVENTION

This invention relates to means for tensioning of drums, and, more particularly, to means for indicating the degree of tension applied to each of a plurality of drum head retainers.

Conventional music drums typically consist of two heads (diaphragms or skins) mounted on a cylindrical body (drum shell). This construction allows the vibrations on one head to be transferred through the air inside the drum shell to the other head and cause the other head also to vibrate. The drum heads or skins are held in place over the drum shell by drum hoops or rims.

Tuning screws, generally six or eight in number, pass through apertures in each drum rim and are screwed into fixed brackets which are mounted at uniformly spaced positions around the drum shell. Such an assembly is usually referred to as a drum head retainer. Tuning of the drum is accomplished by turning the screws into brackets. This operation serves to draw the drum rim down over the end of the drum shell, thereby applying tension to the drum skin, which is thus stretched over the end of the drum shell. This tuning operation normally occupies some considerable time, since each individual tuning screw must be individually tuned until the desired pitch or tune is achieved.

Some drum varieties consist of only one head, for example, the bongo, the timpani and some brass drums. Other drum varieties include the kettle drum, the dawul, the side drum, the tenor drum and the snare drum, just to mention a few. The snare drum has wires stretched across one of the heads; these wires beat against the head when it vibrates and produce high frequency fibrations that add more noise to the sound of the drum. All such drums are intended to be improved by the drum head retainer of this invention.

Examples of various drum head retainers are disclosed in U.S. Pat. Nos. 4,334,458, 4,206,681, 4,122,747, 2,172,578, 2,092,980, 2,009,061 and 1,995,066. Typically, all such retainers require individual tuning to obtain a desired pitch.

Indicating means have been developed to show the extent of tension of the drum head; an example of such indicating means is found in U.S. Pat. No. 1,391,786. Nevertheless, there remains a need for a drum head retainer that is easily constructed, easily tuned and provides an indication of the extent of tension applied to the drum head.

OBJECTS AND SUMMARY OF THE INVENTION

It is an object of this invention to provide a drum head retainer for drums.

It is another object of this invention to provide a drum head retainer that is easily constructed.

It is yet another object of this invention to provide a drum head retainer that includes indicating means to display the extent of tension applied to the drum heads or skins.

It is still another object of this invention to provide a drum head retainer having a metered nut to enable tightening or tensioning of the drum head to the same degree for each retainer on the drum.

These and further objects of the invention will become apparent from the hereinafter following commentary taken in conjunction with the drawing.

In accordance with the invention, a drum head retainer is provided. The drum head retainer, a plurality of which would be spaced equally about the circumference of a drum, comprises a casing having a vertical channel therein and an apertured side communicating with a portion of the vertical channel. The vertical channel terminates in an upper opening and a lower opening. Means are provided for attaching the casing to the side wall of the drum. A threaded bolt passes downwardly through the upper opening and is threaded into a flanged nut having a predetermined length. The upper end of the bolt passes through means for providing tension to a drum head. A spring is maintained in the casing between the upper opening and the flange or upper surface of the nut. Indicating means are provided by the flange of the nut indexing the amount of tension by moving upwards, whereby it aligns with metered markings on the casing.

Turning of the bolt in a given direction applies tension to the drum head and simultaneously moves the nut such that the top of the nut provides an indication, relative to the indicating means, of the extent of tension applied to the drum head. The construction of the drum head retainer is simple, and its use ensures a professional sound for even the most inexperienced drummer.

DESCRIPTION OF THE BEST EMBODIMENTS CONTEMPLATED

Figure 1:
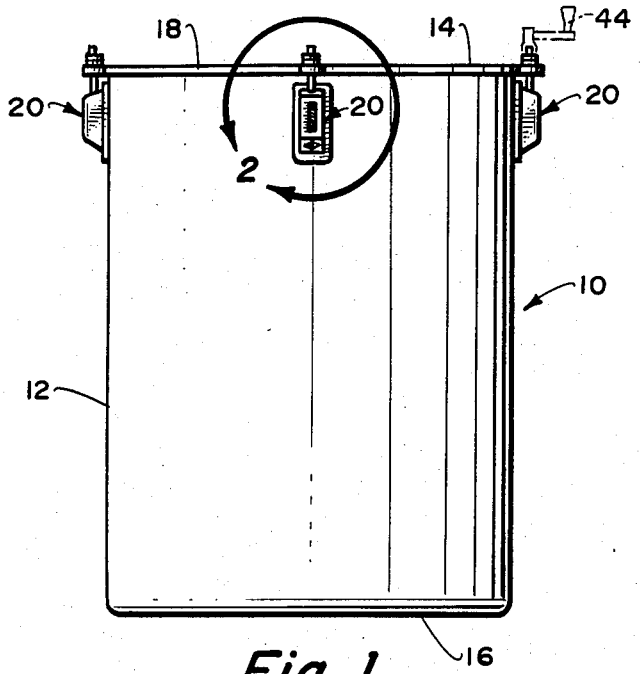
FIG. 1 is a side elevation view of a drum showing a plurality of drum head retainers of the invention in position.

Referring to the drawing wherein like numerals of reference designate like elements throughout, a drum 10 is depicted in FIG. 1, shown here comprising a hollow shell 12, a top 14 and a bottom 16. A hoop or rim 18 encircles the top 14 and secures a drum head (not shown) having a composition common to musical drums. Although the drum 10 depicted herein has one head, it will be appreciated that the drum head retainer of the invention is equally suitable for drums with two heads.

Figure 3:
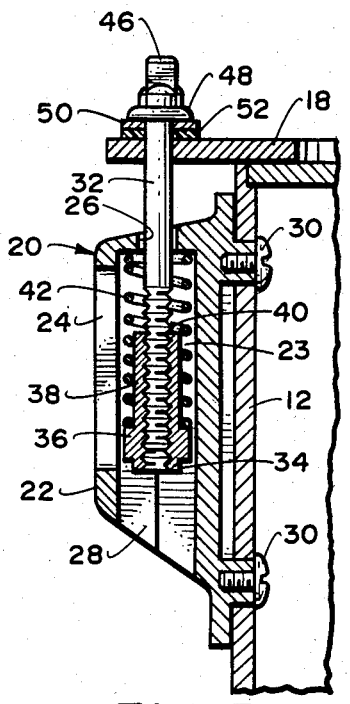
FIG. 3 is a cross-section view of the side of the drum head retainer of the invention taken along the line 3—3 of FIG. 2.
Figure 2:
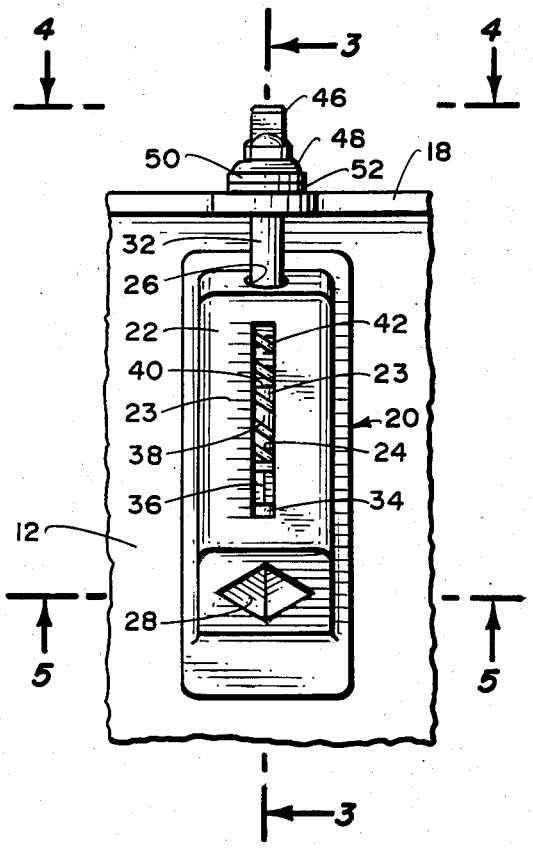
FIG. 2 is an enlargement of one of the retainers shown in FIG. 1.
Figure 4:
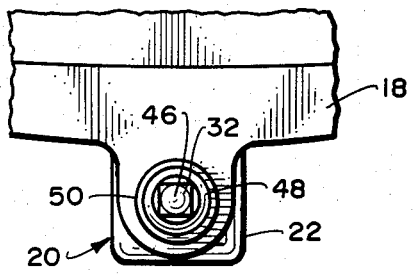
FIG. 4 is a top plan view of the drum head retainer taken along the line 4—4 of FIG. 2.

A plurality of drum head retainers 20 are equally spaced along the circumference of the rim 18. As shown in greater detail in FIGS. 2 and 3, the drum head retainer comprises a casing 22 having a vertical channel 23. An apertured side 24 of the casing 22 communicates with a portion of the channel 23, which terminates in an upper opening 26 and a lower opening 28. Means 30, here, screws, are provided for attaching the drum head retainer 20 to the side wall 12 of the drum 10.

A bolt 32 having threads along a substantial portion of its length passes downwardly into the vertical channel 23 through the upper opening 26. A nut 34 having a flange or shoulder 36 is threaded onto the bolt. The nut has an upwardly extending portion 38, terminating in top end 40.

A spring 42 is maintained between the upper opening 26 and the flange 36 of the nut 34. The spring provides tension as the bolt 32 is tightened. A tensioning key 44, depicted in phantom in FIG. 1, fits over the top 46 of the bolt, which is formed in the conventional manner to receive the key.

Below the top 46 of the bolt 32 is a flange 48. A metal washer 50 and a resilient washer 52 provide support for tightening the bolt and applying tension to the drum head.

As described above, the drum head retainer of the invention is adapted to be screwed on the side walls of a drum, and has means for being received in the eyelets of a hoop used to position the membrane, or drum head, in relation to the drum. The nut is positioned at the bottom of the retainer, and receives the threaded portion of the bolt, the bolt being disposed through a spring within the housing of the retainer. The relative positioning of the bolt, spring and nut serves to exert a continuing downward, or biasing, force to retain the membrane in a stretched relationship to the drum head.

The upwardly extending portion 38 of the nut 34 helps to center the spring while the flange of the bolt indexes the tension so that when the bolts 32 of the plurality of the drum head retainers 20 are tightened, as by means of a key 44, the tightening may be done in an equal manner, so as to provide equal tension about the circumference of the drum 10 and may be observed from time to time to ensure the continuing equal tension. Such markings may be viewed relative to a means for indicating, such as a reference mark 21, on the apertured side 24 of the casing 22 near the aperture.

Alternatively, and preferably, the apertured side 24 of the casing 22 may have markings formed thereon and the top end 40 of the nut 34 may be viewed relative to the markings.

Figure 5:
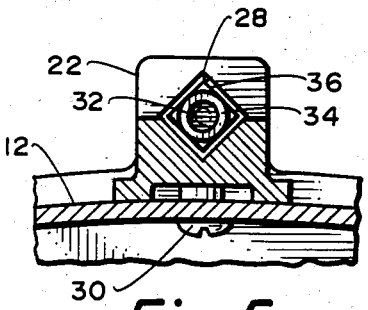
FIG. 5 is a bottom plan view of the drum head retainer taken along the line 5—5.
Figure 6:
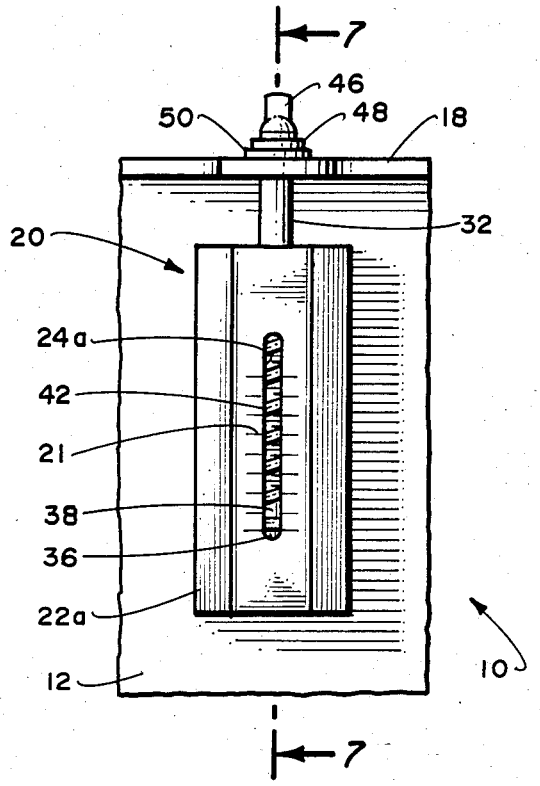
FIG. 6 is a side elevation view of an alternate embodiment of the drum head retainer of the invention.
Figure 7:
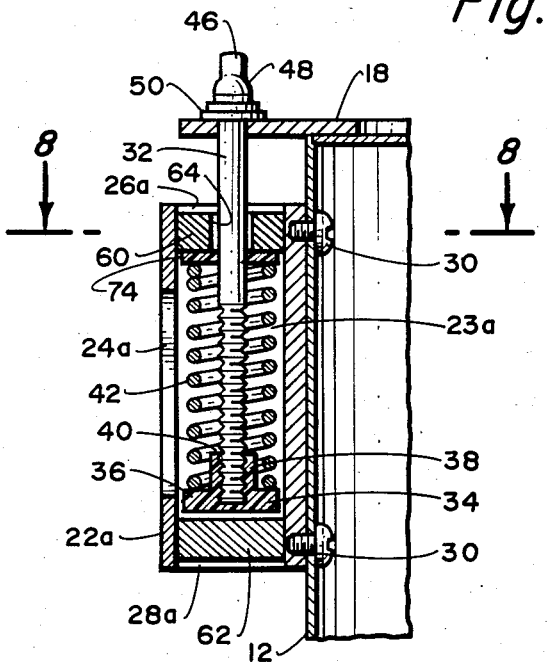
FIG. 7 is a cross-section view taken along the line 7—7 of FIG. 6.

The lower opening 28 of the casing 22 should preferably be formed in a square or diamond shape, as depicted in FIG. 5. If formed in such a manner, the length of the sides of the bottom opening 28 should be slightly larger than the cross-sectional length of the flange 36 of the nut 34 to just accomodate the flange. It will be appreciated that the cross-sectional length of the flange 36 is at least the same as the diameter of the spring 42, in order to support the spring.

In such a case, the flange 36 is also four-sided, and, upon tightening of the nut 34, will fit within the lower opening 28. Most preferably, the entire channel 23 has the square or diamond cross-sectional configuration. Such a configuration avoids an undesirable lip, which a circular cross-sectional configuration (i.e., cylindrical configuration) of the channel 23 would otherwise possess, and permits complete freedom in tightening the nut 34 the entire length of the channel to the extent the spring 42 permits.

The lower opening 28 of the housing or casing 22 may be left open, as depicted in the Figures and as discussed above. Such an arrangement permits ready access to the nut 34 and allows changing of the spring 42 by the consumer in the event the spring wears out. Alternatively, the bottom of the casing may be closed and, if desired, a quantity of white grease included in the enclosed portion. In such a situation, a clear plastic window may be provided to cover the aperture in side 24, thereby completely sealing the enclosed portion and still permitting viewing of the position of the nut with respect to the markings on the side of the casing. An O-ring or similar seal may be provided at the top opening 26 of the casing to totally seal the enclosed portion from external contamination.

Figure 8:
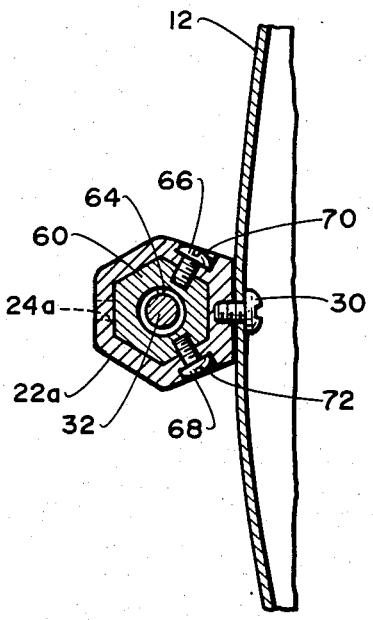
FIG. 8 is a cross-section view taken along the line 8—8 of FIG. 7.

In a preferred embodiment, the drum head retainer 20 is provided with a casing **22*a* having an approximately hexagonal cross-section, as shown more clearly in FIG. 8. Vertical channel 23*a* is also of hexagonal cross-section. Aperture portion 24*a* on one side of the casing communicates with a portion of the vertical channel 23*a*. The vertical channel terminates in an upper opening 26*a* and a lower opening 28*a*. Means 30, such as screws, attach the drum head retainer to the side wall 12 of the drum 10**.

Bolt 32 having threads along a substantial portion of its length passes downwardly into the vertical channel **23*a* through the upper opening 26*a***.

The upper opening **26*a* and lower opening 28*a* are provided with retainers 60, 62 for keeping the nut 34 and spring 42 in the channel 23*a*. The retainers 60, 62 are also of hexagonal shape and are of slightly smaller dimension to easily fit in the channel 23*a*. The upper retainer 60 is provided with an unthreaded, central opening 64, slightly larger than the diameter of the shank of bolt 32 and helps to maintain the bolt 32** in an approximately vertical, centered altitude.

The lower retainer 62 is preferably solid, but may be likewise provided with an unthreaded central opening (not shown). In the preferred embodiment the length of the shank of bolt 32 is sized to fit within the confines of the channel **23*a*, as defined by the solid retainer 62**.

The retainers 60, 62 are each secured in place by screws 66, 68 which are counter-sunk in openings 70, 72, respectively, of the casing **22*a*. The retainers 60, 62 are blind-threaded to accept the screws 66, 68**.

As above, the nut 34 is defined by a flange portion 36 and an upwardly extending portion 38, terminating in top end 40. Spring 42 is maintained between a washer 74, urged against the bottom of retainer 60 and the top of the flange 36. The nut 34 and washer 74 preferably comprise a low friction plastic material, such as nylon or polytetrafluoroethylene.

As above, the top 46 of the bolt 32 is formed to receive a tensioning key. The upper portion of the bolt 32 is provided with a flange 48 and a metal washer 50 for support for tightening the bolt 32 and applying tension to the drum head.

Markings 21 are provided along the side of aperture **24*a* to provide a reference against which the flange portion 36 of the nut 34** may be viewed in the tensioning process.

Thus, there has been described a drum head retainer provided with indicating means. Various modifications and changes will make themselves available to those of ordinary skill in the art and all such changes and variances not deviating from the spirit and essence of the invention are intended to be covered by the appended claims.

What is claimed is:

1. A drum head retainer for a drum employing a plurality of drum head retainers comprising:

(a) a casing having a vertical channel and an apertured side communicating with a portion of said vertical channel, said vertical channel terminating in an upper opening and a lower opening;

(b) means for attaching said casing to the side wall of a drum;

(c) a threaded bolt passing downwardly through said upper opening and threaded into a flanged nut provided with an integral, upwardly extending cylindrical portion and having a predetermined length, the upper end of which bolt is adapted for passing through means for providing tension on a drum head, said flange portion of said nut accommodated in said lower opening so as to provide lateral support of said nut;

(d) a spring maintained in said casing between said upper opening and the top of said flange of said nut, centered in said vertical channel by said upwardly extending portion of said nut; and (e) indicating means comprising a series of parallel markings for providing a measure of tension, said means indicating the relative position of a portion of said nut, whereby turning of said bolt in a given direction applies tension to said drum head and simultaneously moves said nut relative to said indicating means so as to provide a measure of the extent of tension applied to said drum head.

2. The drum head retainer of claim 1 in which said bottom opening permits accessibility to said nut.

3. The drum head retainer of claim 1 in which said bottom opening is sealed and a clear plastic window is attached to said apertured side.

4. The drum head retainer of claim 1 in which said indicating means comprise markings on a portion of said apertured side of said casing, to which said nut is moved relative thereto.

5. The drum head retainer of claim 1 in which said flange of said nut and said bottom opening each have a substantially square cross-section, with said bottom opening slightly larger than said flange.

6. The drum head retainer of claim 5 in which said vertical channel has a substantially square cross-section, slightly larger than said flange.

7. The drum head retainer of claim 1 in which said bolt includes a top portion having (a) means adapted to receive a tuning key and (b) a flange positioned below said receiving means.

8. The drum head retainer of claim 7 in which said bolt passing through said means for providing tension on said drum head is spaced from said means by a washer assembly between said flange on said bolt and said means.

9. The drum head retainer of claim 8 in which said washer assembly comprises a metal washer and a resilient washer.

10. A drum head retainer for a drum employing a plurality of drum head retainers comprising:

(a) a metal casing having a vertical channel and an apertured side communicating with a portion of said vertical channel, said vertical channel terminating in an upper opening and a lower opening;

(b) means for attaching said casing to the side wall of the drum, comprising threaded holes for receiving threaded screws;

(c) a threaded bolt passing downwardly through said upper opening and threaded into a flanged nut provided with an integral, upwardly extending cylindrical portion and having a predetermined length, the upper end of which bolt is adapted for passing through a hoop on said drum for providing tension on a drum head, said flange portion of said nut accommodated in said lower opening so as to provide lateral support;

(d) a spring maintained in said casing between said upper opening and the top of said flange of said nut, centered in said vertical channel by said upwardly extending portion of said nut; and (e) indicating means comprising a series of parallel markings on said apertured side of said casing, said means indicating the relative position of a portion of said nut, whereby turning of said bolt in a given direction applies tension to said drum head and simultaneously moves said nut relative to said indicating means so as to provide a measure of the extent of tension applied to said drum head.

11. A drum head retainer for a drum employing a plurality of drum head retainers comprising:

(a) an elongated casing having an interior vertical channel therethrough and an apertured portion along one side of said casing communicating with a portion of said vertical channel, said vertical channel having a hexagonal cross-section and terminating in an upper opening and a lower opening;

(b) means for attaching said casing to the side wall of a drum;

(c) a threaded bolt passing downwardly through said upper opening and threaded into a flanged nut provided with an integral, upwardly extending cylindrical portion and having a predetermined length, the upper end of which bolt is adapted for passing through means for providing tension on a drum head, said flange portion of said nut accommodated in said vertical channel so as to provide lateral support of said nut;

(d) a spring maintained in said casing between said upper opening and the top of said flange of said nut, substantially centered in said vertical channel by said upwardly extending portion of said nut;

(e) indicating means comprising a series of parallel markings along said aperture, said means indicating the position of a portion of said nut relative thereto; and (f) retaining means in said upper and said lower openings, said retaining means fastened to the side of said casing, with the retaining means in said upper opening provided with a hole in the center thereof for maintaining said bolt in vertical, substantially center position.

12. The drum head retainer of claim 11 in which a washer is provided between the top of said spring and the bottom of said upper opening retaining means.

13. The drum head retainer of claim 12 in which said washer and said nut comprise a low friction plastic material.

14. The drum head retainer of claim 11 in which said retaining means are fastened by screws which pass through the wall of said casing.

* * * * *